United States Patent [19]

Newman

[11] 4,345,390

[45] Aug. 24, 1982

[54] SCREEN TENSIONING AND PRINTING FRAME

[75] Inventor: Don E. Newman, Wyncote, Pa.

[73] Assignee: Stretch Devices, Inc., Philadelphia, Pa.

[21] Appl. No.: 206,213

[22] Filed: Nov. 13, 1980

[51] Int. Cl.[3] ..... D06C 3/08

[52] U.S. Cl. ..... 38/102.91

[58] Field of Search ..... 38/102.1, 102.3, 102.4, 38/102.91

[56] References Cited

U.S. PATENT DOCUMENTS

| | | | |
|---|---|---|---|
| 3,507,062 | 4/1970 | Moyer | 38/102.91 |
| 3,553,862 | 1/1971 | Hamu | 38/102.1 |
| 3,601,912 | 8/1971 | Dubbs | 38/102.91 |
| 3,908,293 | 9/1975 | Newman | 38/102.91 |
| 3,950,869 | 4/1976 | Samarin | 38/102.91 |

FOREIGN PATENT DOCUMENTS 921813 3/1963 United Kingdom .

*Primary Examiner*—Louis Rimrodt

*Attorney, Agent, or Firm*—Seidel, Gonda, Goldhammer & Panitch

[57] ABSTRACT

A screen tension and printing frame includes sets of parallel rollers coupled at their ends to corner members. Each roller is coupled to one edge portion of a screen. The screen is sealed with a respect to a dam member located inwardly of the rollers. A discrete member is connected to each dam member for preventing the associated roller from bowing inwardly toward its associated dam member, including a limit stop connected to each dam member by at least one web.

16 Claims, 9 Drawing Figures

FIG. 1
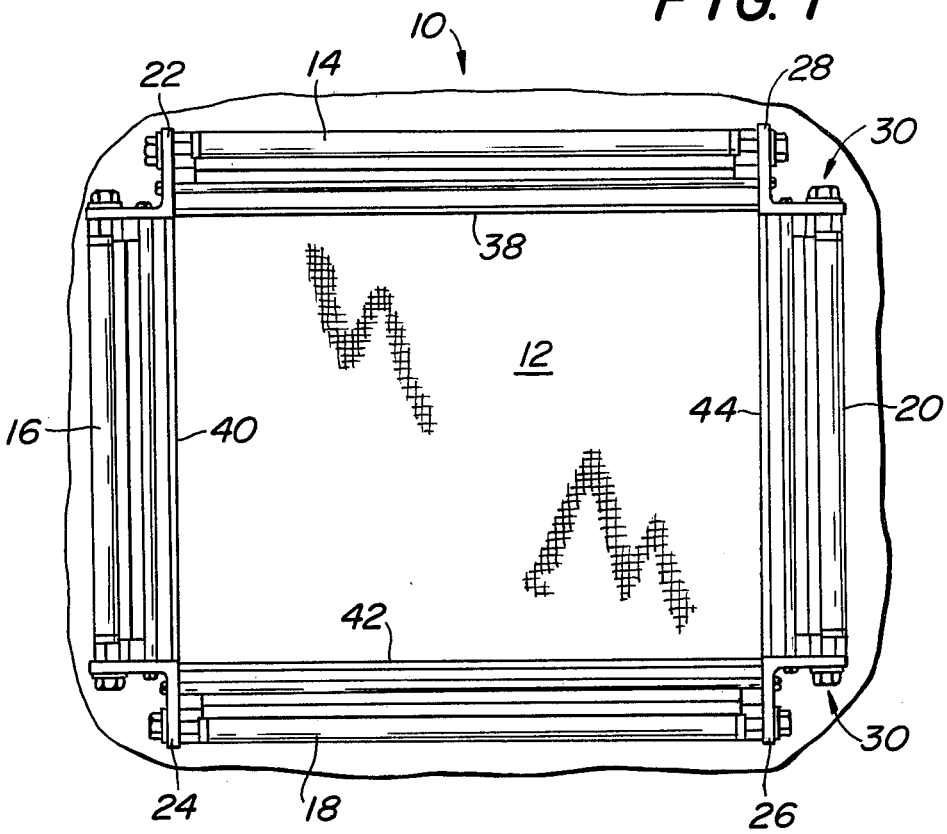
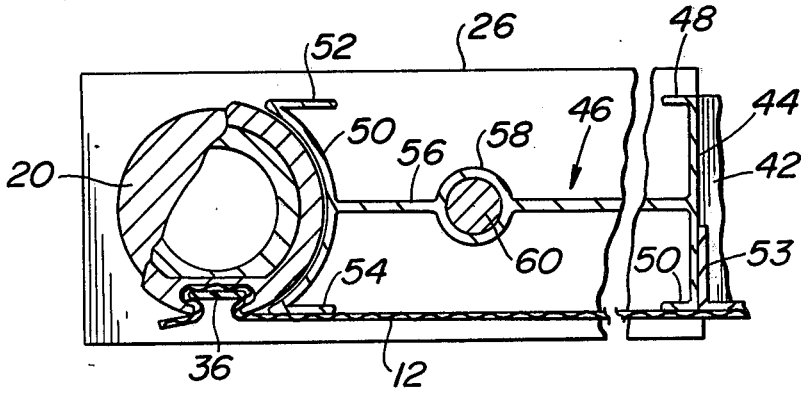
FIG. 3

FIG. 4
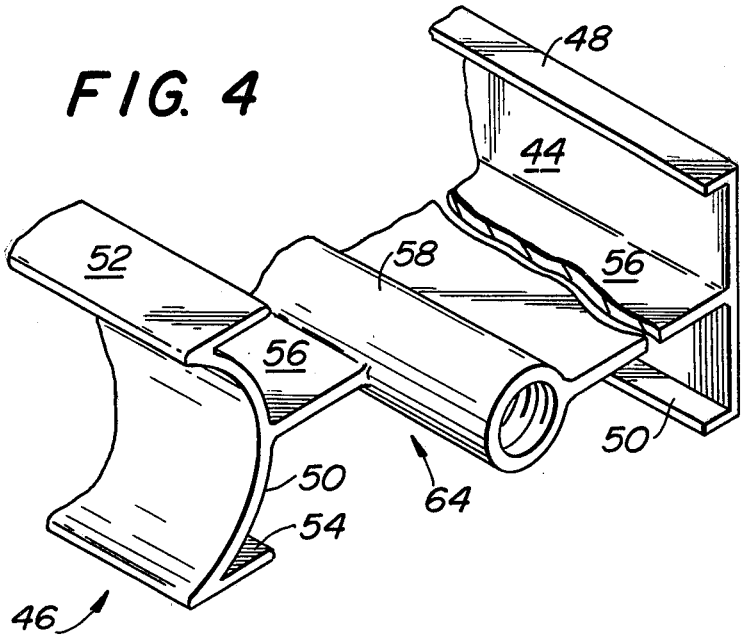
FIG. 5
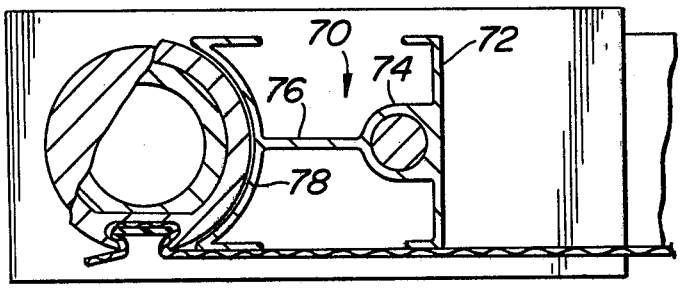
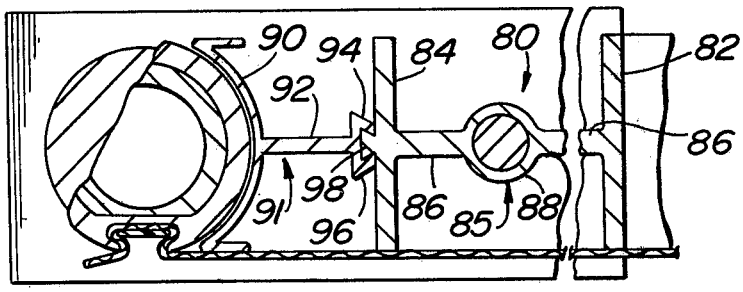
FIG. 6

FIG. 7
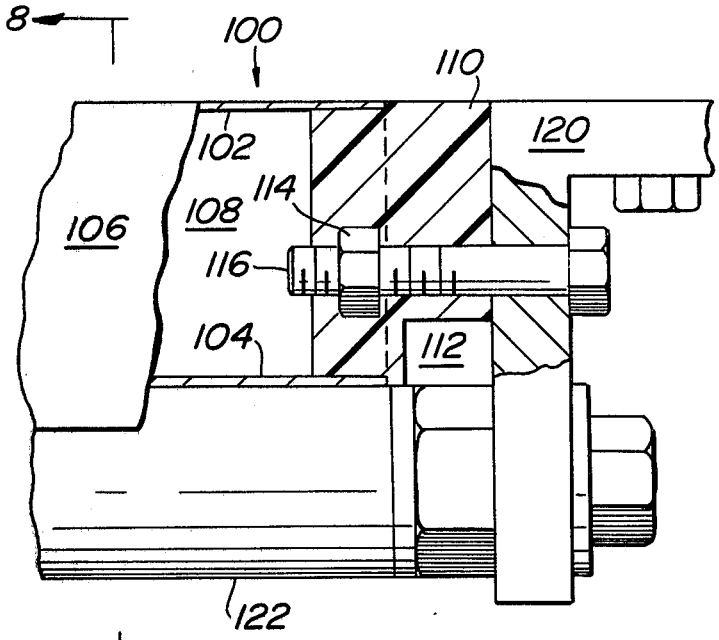
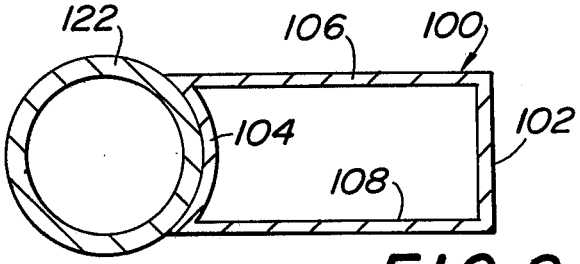
FIG. 8
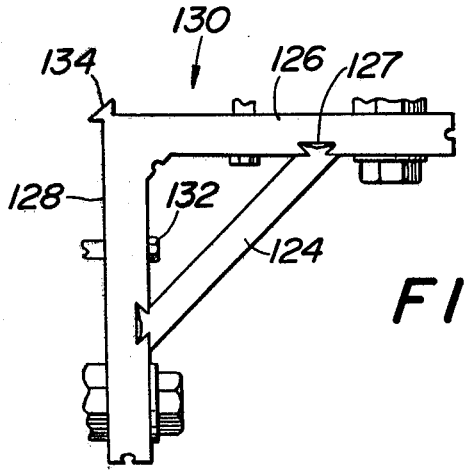
FIG. 9

SCREEN TENSIONING AND PRINTING FRAME

BACKGROUND

The subject matter of this application is an improvement on the frame disclosed in my U.S. Pat. No. 3,908,293. The frame as disclosed in said patent has performed very well when none of the sides of the frame have a length greater than about 5 feet and a roller diameter of about 1⅝ inches and roller wall thickness of about 1/16 inch. When a side of the frame has a length such as 14 feet, it is necessary to progressively increase the diameter of the rollers up to about 5 inches and/or increase wall thickness of the roller. Otherwise, the rollers bow inwardly to an excessive degree.

There is a limit to the thickness of the frame which can be handled by existing screen printing presses. Thus, most presses cannot accommodate a frame when the rollers or any other portion of the frame have a thickness of about 1¾ to 2¼ inches. Some types of printing are best performed with a slight amount of bowing while other types of printing require no bowing of the rollers.

The present invention is a solution to the problem of how to prevent rollers from bowing inwardly to an excessive degree on large frames wherein one side has a length greater than about 5 feet while maintaining a thin profile so that the frame can be accommodated by existing screen printing presses.

SUMMARY OF THE INVENTION

The present invention is directed to apparatus which includes a screen tensioning and printing frame. The frame has a plurality of rollers coupled together by corner members which support the rollers for rotation about their longitudinal axes. Each roller has a longitudinally extending channel on its periphery. A retainer for each channel is provided to retain one edge portion of a screen fabric in each channel. A means is associated with each corner member for locking each roller in a predetermined rotative position so that a desired tension may be applied to the screen fabric. A dam member is associated with each roller. Each dam member is inwardly of its associated roller and extends between adjacent corner members for forming a dam for printing medium to be applied through the screen fabric.

The apparatus of the present invention includes a discrete means connected to each dam member and cooperating therewith for preventing the associated roller from bowing inwardly toward its associated dam member. The last-mentioned means includes a discrete limit stop between each roller and associated dam member. Each limit stop is connected to its associated dam member by at least one web.

It is an object of the present invention to provide a screen tensioning and printing frame of low profile and structurally interrelated in a manner so that one or more sides may have a length greater than about 5 feet without the roller bowing inwardly at all or only bowing inwardly to an acceptable amount.

It is another object of the present invention to provide a screen tensioning and printing frame wherein the strength of the dam member is improved and utilized as part of a beam to resist inward bowing of an associated roller.

It is another object of the present invention to provide a printing frame which is structurally interrelated in a manner so that it may be used on small and large printing frames while at the same time having a horizontally disposed surface for clamping into the press thereby eliminating the need for a clamp adaptor on many types of presses.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of a frame in accordance with the present invention.

FIG. 3 is a sectional view taken along the line 3—3 in FIG. 2.

FIG. 4 is a perspective view of a portion of a dam member and its associated limit.

FIG. 5 is a sectional view similar to FIG. 3 but showing another embodiment.

FIG. 6 is a sectional view similar to FIG. 3 but showing still another embodiment.

FIG. 7 is a plan view of one end of another beam.

FIG. 8 is a sectional view taken along the line 8—8 in FIG. 7.

FIG. 9 is a plan view of a modified corner member.

DETAILED DESCRIPTION

Figure 2:
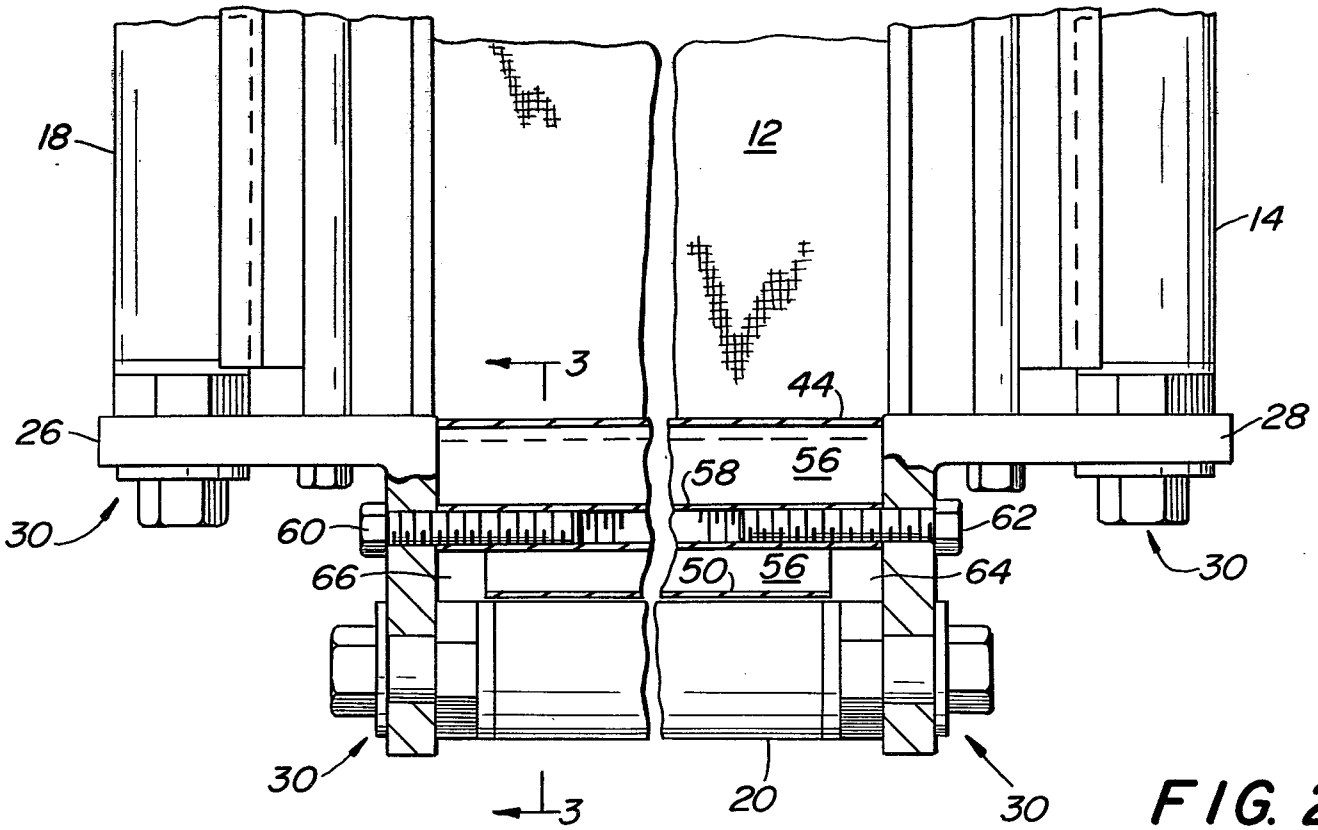
FIG. 2 is an enlarged detailed view of a portion of the frame shown in FIG. 1.

Referring to the drawings in detail, wherein like numerals indicate like elements, there is shown in FIG. 1 a screen tensioning and printing frame 10 in accordance with the present invention. A screen fabric 12 is applied to one face of the frame 10 in a manner to be described in detail hereinafter.

The frame 10 has as its main structural element a plurality of rollers, namely rollers 14 and 18, parallel to each other and rollers 16 and 20, parallel to each other. Roller 14 is mutually perpendicular with respect to rollers 16 and 20. The rollers 14, 16, 18 and 20 are rotatably supported at their ends by generally L-shaped corner members 22, 24, 26 and 28.

The rollers 14, 16, 18 and 20 are preferably hollow rollers and preferably are made from a lightweight, non-corrosive material such as aluminum but may be made from steel or other materials. The corner members 22, 24, 26 and 28 are rigid members made from a lightweight, non-corrosive material such as aluminum but may be made from steel or other materials. Each end of each of said rollers is coupled to its associated corner member by a locking means 30. Each locking means 30 applies an axial clamping force on its associated roller and preferably is a friction lock. Each locking means 30 facilitates locking each roller in a predetermined rotative position so that a desired tension may be applied to one side edge of the screen fabric 12. Each locking means 30 may be of the type disclosed in my above-mentioned patent.

Each of the rollers may be of the type as disclosed in greater detail in my above-mentioned patent. Each roller may be provided with a groove for receiving a side edge portion of the screen fabric 12 with a retainer 36 being provided as described in my above-mentioned patent.

A dam member 38 is associated with the roller 14. A dam member 40 is associated with the roller 16. A dam member 42 is associated with the roller 18. A dam member 44 is associated with the roller 20. The interrelationship of each roller and its associated dam member is the same. Hence, only the interrelationship between roller 20 and its associated dam member 44 will be described in detail.

A discrete means is associated with each dam member for preventing its associated roller from bowing inwardly. In the preferred embodiment, each such discrete means is a generally I-shaped beam 46 with dam member 44 being a vertical leg thereof. Dam member 44 has outwardly extending flanges 48, 50. The distance across the outside surfaces of flanges 48, 50 may be greater than or the same as the diameters of roller 30 but preferably is slightly less than the diameter of roller 30 to reduce frictional drag on the fabric 12. Another leg of the beam 46 is defined by the limit stop 50 having inwardly extending flanges 52, 54. The flanges 48, 50, 52 and 54 are horizontally disposed. The fabric 12 may be sealed to member 44 in any conventional manner such as by use of a strip of tape 53 as shown in FIG. 3.

The limit stop 50 is arcuate with a radius of curvature corresponding to or slightly greater or slightly smaller than the radius of curvature of roller 20. Limit stop 50 intermediate its upper and lower ends at the same elevation of the axis of roller 20 is coupled by way of a horizontally disposed web 56 to the dam member 44.

Intermediate its ends, the web 56 is provided with an integral cylindrical portion 58 which is threaded on its inner periphery. One end of the cylindrical portion 58 is connected to the L-shaped corner member 26 by way of bolt 60. A similar bolt 62 interconnects the corner member 28 and the cylindrical portion 58. Thus, the beam 46 is connected to the corner members 26 and 28 by way of the bolts 60, 62. The end portions of the web 56 located between cylindrical portion 58 and the limit stop 50 are provided with notches designated 64 and 66. See FIGS. 2 and 4. The notches 64 and 66 facilitate turning a wrench to adjust the tension in the screen fabric 12 by rotating the roller 20.

The beam 46 utilizes the strength of a I-beam to resist inward bowing of the roller 20 while using the dam member 44 as one leg of the I-beam and with the web of the I-beam as part of the means for securing the beam to the corner members. Other configurations of the I-beam are shown in FIGS. 5 and 6.

Referring to FIG. 5, there is shown another embodiment of the present invention which is identical to that described above except for variations in the configuration of the I-beam. The beam 70 is generally I-shaped with the dam member 72 as one leg of the beam. Dam member 72 is integral with and directly connected to the cylindrical portion 74. Cylindrical portion 74 corresponds to portion 58 but there is no portion of the web 76 extending between dam member 72 and cylindrical portion 74. The limit stop 78 is identical with limit stop 50 and is connected to one end of the web 76. Beam 70 is narrower than the beam 46 and facilitates employing the present invention in connection with smaller size frames providing for greater interior print area.

In FIG. 6, there is illustrated another embodiment of the present invention which is identical with that described above except for the configuration of the beam. The beam 80 may be made in one integral piece or in two separate pieces. As illustrated, the beam 80 is made in two pieces and includes an I-beam section having legs 82, 84 interconnected by a web 86. The web 86 contains the cylindrical portion 88. Leg 82 is the dam member. A second piece of the beam 80 includes a limit stop 90 having an integral web 92 terminating in converging flanges 94, 96. Leg 84 has a projection 98 defined by converging surfaces adapted to mate with corresponding surfaces on the flanges 94, 96. By using a beam 80 comprised of two sections designated 85 and 91, it is possible to stock the sections and custom assemble one beam section 91 with beam sections 85 having webs 86 of varying lengths depending upon the required rigidity. By using a beam 80 in two sections, section 91 can be cut so as to have a length shorter than the length of section 85 whereby notches similar to notches 66 are attained without having to saw, stamp, or otherwise fabricate the notches.

Referring to FIGS. 7 and 8, there is shown another embodiment of the present invention which is identical to that described above except as follows. The beam 100 is generally rectangular in section with the dam member 102 as one leg of the beam. The curved limit stop 104 is connected to the dam member 102 by webs 106, 108. Each end of beam 100 is closed by a plastic end plug 110 which is preferably secured thereto by a force fit.

Plug 110 has a notch 112 which corresponds to notches 64, 66. Plug 110 is cast or molded so as to have a nut 114 embedded therein and aligned with a bore for accommodating bolt 116. If desired, nut 114 can be force-fit into the plug bore or the plug bore can be threaded. Bolt 116 extends through the plug bore, and is threaded to nut 114 for securing the beam 100 to corner member 120. Roller 122 is rotatably connected to corner member 120 as described above. The upper surface of web 106 provides a clamping surface as described above in connection with flange 52.

On large frames, the forces generated may cause the corner members to deform. I solve this problem by providing a strut 124 between the legs 126 and 128 of corner member 130. See FIG. 9. Legs 126, 128 have a dovetail slot 127 for receiving a mating dovetail projection on the ends of strut 124. Strut 124 is readily removable to facilitate access to bolts such as bolt 132. The dovetail projections on the strut 124 are preferably concave on their outer surface as shown. A truncated triangular projection 134 at the intersection of legs 126, 128 may be provided for contact with an end portion of a dam member to oppose twisting of the dam member. Dovetail slots 127 can be on the ends of strut 124 with mating projections on the legs 126, 128 if desired.

In each of the embodiments of the present invention, it will be noted that the beams are uniform in cross-section whereby they may be extruded and then cut to desired length. This facilitates ease of manufacture, ease of assembly and minimizes production costs since machining is minimal. The manufacturing involved includes providing the notches 62, 64 and threading the cylindrical members 58, 74 or 88.

Uniformity of tension in fabric 12 is a function of bowing of rollers. The beams disclosed herein at least partially oppose bowing of rollers. That is, some bowing of rollers is permitted but undesired excessive bowing is prevented. Also, the beams disclosed herein can be locked by means 30 whereby no bowing at all is permitted where extremely accurate printing is to be performed.

Thus, the beam feature of each embodiment facilitates increasing the ridigity of the frame to prevent inward bowing of the rollers and/or permit some bowing which is not excessive, increases structural rigidity against deformation out of square under load, and helps to maintain the frame planar, all without increasing the diameter of the rollers or other components whereby the frame may be accommodated by existing screen printing presses. Each embodiment facilites the provision of a horizontally disposed surface adjacent the limit stop so that the frame may be clamped to many types of presses without need for an adaptor. In each embodiment, the dam member has the added attribute of being an integral part of a beam. In each embodiment, the beam does not interfere with spray cleaning of the frame and there are no compartments where cleaning solvents can accumulate.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising a screen tensioning and printing frame, said frame having a plurality of rollers coupled together by corner members which support the rollers for rotation about their longitudinal axes, each roller having a longitudinally extending channel on its periphery, a retainer means for each channel to retain an edge portion of a screen fabric in each channel, means associated with each corner member for locking each roller in a predetermined rotative position so that a desired tension may be applied to a screen fabric, a dam member associated with each roller, each dam member being inwardly of its associated roller and extending between adjacent corner members so that the dam members may form a dam for a printing medium to be applied through a screen fabric, the improvement comprising a discrete means connected to each dam member and cooperating therewith for at least partially opposing undesired inward bowing of the associated roller, said last-mentioned means including a discrete limit stop between each roller and its associated dam member, each limit stop being connected to its associated dam member by at least one web.

2. Apparatus in accordance with claim 1 wherein each discrete means is a generally I-shaped beam with the dam member being a vertical leg of the beam.

3. Apparatus in accordance with claim 2 wherein each limit stop is arcuate in section so as to have a concave surface juxtaposed to the periphery of its associated roller.

4. Apparatus in accordance with claim 3 wherein said limit stop has a horizontally disposed flange at its upper end for clamping engagement with a portion of a printing press.

5. Apparatus in accordance with claim 1 wherein each web includes a cylindrical portion internally threaded and bolted at its opposite ends to an adjacent corner member.

6. Apparatus in accordance with claim 1 wherein each discrete means is comprised of two separable elements with the limit stop being one of the separable elements and having mating surfaces for contact with the other of the separable elements.

7. Apparatus comprising a screen tensioning and printing frame, said frame having a plurality of rollers coupled together by corner members which support the rollers for rotation about their longitudinal axes, each roller having a longitudinally extending channel on its periphery, a retainer means for each channel to retain an edge portion of a screen fabric in each channel, means associated with each corner member for locking each roller in a predetermined rotative position so that a desired tension may be applied to a screen fabric, a dam member associated with each roller, each dam member being inwardly of its associated roller and extending between adjacent corner members so that the dam members may form a dam for a printing medium to be applied through a screen fabric, a discrete generally I-shaped beam associated with each roller for at least partially preventing each roller from bowing inwardly, each such beam having one of said dam members as a vertical leg thereof on the side of the beam remote from its associated roller.

8. Apparatus in accordance with claim 7 wherein each said beam includes a limit stop having a surface juxtaposed to its associated roller and connected to its associated dam member by a horizontally disposed web lying in a plane which is horizontal and contains the axis of its associated roller.

9. Apparatus in accordance with claim 8 wherein the upper end of each limit stop has a horizontally disposed flange extending inwardly toward its associated dam member.

10. Apparatus in accordance with claim 8 wherein said limit stop surface is concave and is one flange of it associated I-shaped beam.

11. Apparatus in accordance with claim 7 wherein said I-shaped beam is associated with a discrete separate limit stop located between each roller and its associated beam.

12. Apparatus comprising a screen tensioning and printing frame, said frame having a plurality of rollers coupled together by corner members which support the rollers for rotation about their longitudinal axes, means associated with each corner member for locking each roller in a predetermined rotative position so that a desired tension may be applied to a screen fabric, a discrete beam associated with each roller, means securing the ends of each beam to a pair of the corner members, each such beam having a dam member as a vertical leg thereof on the side of the beam remote from its associated roller and a roller limit stop on the other side of the beam, each limit stop being connected to its associated dam member by at least one web.

13. Apparatus in accordance with claim 12 wherein each limit stop is connected to its associated dam member by at least two webs.

14. Apparatus in accordance with claim 12 wherein said corner members are L-shaped so as to have two legs, and a strut extending between the legs of each corner member.

15. Apparatus in accordance with claim 14 wherein the ends of the struts are coupled to the legs of the corner members by mating dovetail projections and slots.

16. Apparatus comprising a screen tensioning and printing frame, said frame having a plurality of rollers coupled together by corner members which support the rollers for rotation about their longitudinal axes, each roller having a retainer means to retain an edge portion of a screen fabric, means associated with each corner member for locking each roller in a predetermined rotative position so that a desired tension may be applied to a screen fabric, a dam member associated with each roller, each dam member being inwardly of its associated roller and extending between adjacent corner members so that the dam members may form a dam for a printing medium to be applied through a screen fabric, a discrete limit stop between each roller and its associated dam member for at least partially opposing undesired inward bowing of the associated roller, each limit stop having a web extending inwardly toward its associated dam member.

* * * * *